US008231382B2

(12) United States Patent
Perry et al.

(10) Patent No.: US 8,231,382 B2
(45) Date of Patent: Jul. 31, 2012

(54) APPARATUS AND METHOD FOR THERMALLY REMOVING COATINGS AND/OR IMPURITIES

(76) Inventors: Ophneill Henry Perry, Nottingham (GB); Rifat Alchalabi, Fanwood, NJ (US)

( * ) Notice: Subject to any disclaimer, the term of this patent is extended or adjusted under 35 U.S.C. 154(b) by 965 days.

(21) Appl. No.: 11/909,568

(22) PCT Filed: Mar. 24, 2006

(86) PCT No.: PCT/GB2006/001106

§ 371 (c)(1),
(2), (4) Date: Jun. 11, 2008

(87) PCT Pub. No.: WO2006/100512

PCT Pub. Date: Sep. 28, 2006

(65) Prior Publication Data

US 2009/0038177 A1 Feb. 12, 2009

Related U.S. Application Data

(63) Continuation-in-part of application No. 10/311,025, filed on Dec. 11, 2002, now Pat. No. 7,331,119.

(30) Foreign Application Priority Data

Mar. 24, 2005 (GB) ..... 0506033.0

(51) Int. Cl.
*F26B 17/12* (2006.01)

(52) U.S. Cl. ..... 432/124; 34/168; 34/169; 34/187; 34/131; 34/132; 34/72; 110/210

(58) Field of Classification Search ..... 432/107, 432/112, 117, 124, 141, 195, 206; 110/101 R, 110/209, 210; 451/32, 33, 35, 326, 328, 451/329; 34/164, 165, 169, 184, 187, 130, 34/131, 132

See application file for complete search history.

(56) References Cited

U.S. PATENT DOCUMENTS

| | | | | | |
|---|---|---|---|---|---|
| 2,290,036 | A | * | 7/1942 | Davis | 134/133 |
| 3,171,638 | A | * | 3/1965 | Zimmerley et al. | 432/51 |
| 4,541,346 | A | * | 9/1985 | Culliford | 110/246 |
| 5,055,037 | A | * | 10/1991 | Perry | 432/72 |
| 5,059,116 | A | * | 10/1991 | Gillespie et al. | 432/72 |
| 5,382,002 | A | * | 1/1995 | Evans et al. | 266/205 |
| 7,331,119 | B2 | * | 2/2008 | Perry et al. | 34/168 |
| 2002/0066202 | A1 | * | 6/2002 | Bates et al. | 34/78 |

FOREIGN PATENT DOCUMENTS

| | | | |
|---|---|---|---|
| GB | 2025589 | A | 1/1980 |
| GB | EP253596 | * | 1/1988 |
| GB | 2257239 | A | 1/1993 |

OTHER PUBLICATIONS

Search Report for GB Application No. 0506033.0 dated Jul. 4, 2005.

* cited by examiner

*Primary Examiner* — Gregory A Wilson
(74) *Attorney, Agent, or Firm* — Young Basile

(57) ABSTRACT

This invention relates to apparatus for thermally de-coating and/or drying coated and/or contaminated materials. The apparatus comprises at least one support, an oven (10) mounted to each support and adapted for receiving material to be treated: each oven (10) being moveable between a first position in which a first portion (4) is generally higher than a second portion (6) and a second position in which the second portion (6) is generally higher than the first portion (4) and in use, the or each oven (10) is repeatedly moved between first and second positions to move material within the oven. The apparatus including at least one afterburner (22) for generating a stream of hot gasses and conduit means for directing the stream of hot gasses into a treatment zone of the oven and exhaust means for returning the gasses to the at least one afterburner whereby the or each oven does not include an integral afterburner.

16 Claims, 6 Drawing Sheets

APPARATUS AND METHOD FOR THERMALLY REMOVING COATINGS AND/OR IMPURITIES

CROSS-REFERENCE TO RELATED APPLICATIONS

This application claims priority to GB0506033.0, filed Mar. 24, 2005 by virtue of International Application Number PCT/GB2006/001106, filed Mar. 24, 2006. This application is a continuation-in-part of U.S. patent application Ser. No. 10/311,025 filed on Dec. 11, 2002, now issued as U.S. Pat. No. 7,331,119 on Feb. 19, 2008, which claims priority to GB 0014800.7 filed Jun. 19, 2000 by virtue of International Application No. PCT/GB01/0270 filed Jun. 19, 2001.

BACKGROUND

This invention relates to apparatus and a method for thermally removing coatings and/or impurities from materials, particularly from materials which are particularly suited to batch processing. In particular the present invention relates to a development of the type of oven described in the applicants International Patent Application published as WO 01/98092 A1, the content of which is hereby incorporated by reference in its entirety.

There is an increasing requirement to recycle materials such as aluminum, magnesium and other metals and non-metals. Often such materials will be coated in paint, oil, water, lacquers, plastics, or other volatile organic compounds (V.O.C.s) which must be removed prior to re-melting the materials. For materials which are capable of being processed at relatively high temperatures without melting, such impurities are typically removed using a thermal process which is sometimes known as de-coating. Such thermal de-coating processes can also be used to dry and/or sterilize materials prior to remelting.

For example, aluminum is often used in the production of beverage cans which are typically coated in paint, lacquers and/or other V.O.C.s. Before used beverage cans (U.B.C.s) or scrap material produced during the manufacture of beverage cans be melted down for recycling, any coatings or other impurities must be removed in order to minimize metal loss.

Thermal de-coating, however, is not limited in application to aluminum but can be used to clean or purify any metal or non-metallic materials which are capable of withstanding the temperatures present in the thermal de-coating process. Thermal de-coating can be used to de-coat or purify, for example, magnesium or magnesium alloys, or titanium or titanium alloys.

Known thermal de-coating processes involve exposing the material to be treated to hot gases in order to oxidize the coatings and/or impurities which are to be removed. This exposure takes place in a closed environment in which the temperature and oxygen content of the hot gases can be controlled. Temperatures in excess of 300 C are required to remove most organic compounds and an oxygen level in the range of 6% to 12% is normally required.

If the temperature and oxygen levels of the hot gases are not carefully controlled the decoating process can result in an uncontrolled operation which may be very dangerous.

The material will usually be shredded before treatment and it is important for effective de-coating that all the surfaces of the shredded material are exposed to the hot gases. If this does not occur then the treatment becomes less effective and, in the case of U.B.C.s in particular, a black stain may be left on the surface of the treated material. It is also desirable for the material to be agitated during the treatment to physically remove lose coatings or impurities from the material.

At present there are three main systems which are used for thermal de-coating, these are:

1. Static Oven

In a static oven, the material is stacked on a wire mesh and hot gases are recirculated through the oven to heat the material to the required process temperature.

This arrangement is not efficient because the hot gases do not come in to contact with the materials that are enclosed within the stack of materials on the mesh. As discussed previously, it is important in de-coating that all the surfaces of the materials being treated are exposed to the hot gases. Also there is no agitation of the material being treated.

2. Conveying Oven

This system uses a mesh belt conveyor to transport materials for treatment through an oven. Hot gasses are passed through the material on the belt as it passes through the oven. The problems with this method are as follows:

The depth of materials on the belt limits the process. The materials are stacked, causing similar problems to those found with the static oven in which materials at the centre of the stack do not come into contact with the hot gases.

There is no agitation of the materials, so loose coatings are not removed.

The conveyor belt life is short.

The materials have to be constantly fed.

The process is not suitable for low volume or continuously changing product.

3. Rotating Kiln

A large kiln is inclined to the horizontal so that material fed or charged into the kiln at its highest end travels towards the lowest end, where it is discharged, under the influence of gravity. The kiln is rotated so that material within the kiln is agitated and a flow of hot gases is provided to heat up the material as it travels through the kiln. A number of problems are associated with this method:

The material has to be constantly fed.

The process is not suitable for low volume or continuously changing product.

The continuous process requires air locks at both ends, materials charge end and materials discharge end.

The kiln requires a rotating seal leading to a high level of maintenance.

WO 01/98092 A1 describes a pivotable or tiltable oven that overcomes many of the disadvantages of the previously known apparatus and methods for thermal de-coating. For a detailed description of the construction and operation of the oven, the reader should refer to WO 01/98092 A1. However, briefly, the oven has a charging portion for receiving material to be treated and a changeover portion. Incorporated within the changeover portion is a heat treatment chamber through which a stream or flow of hot gasses can be passed. The oven is pivotally moveable between a first position in which the changeover portion is higher than the charging portion and a second position in which the charging portion is higher than the changeover portion. The arrangement is such that the oven can be repeatedly moved between the first and second positions so that material within the oven falls from one portion to the other portion, passing through the stream of hot gasses in the heat treatment chamber. A method of using the apparatus is also disclosed.

The above known oven has the advantage that it can be used to treat comparatively low volumes of material in a batch process. A further advantage is that by controlling the movement of the oven, the material being treated can be brought into and out of the heat treatment chamber at will, enabling the oven to be operated safely without having an excessive amount of VOC released that could cause self sustained process heating (also known as an autothermic process). This controlled movement ensures that the V.O.C.s are released in a controlled manner and allows a fine degree of control of the treatment process.

In the preferred embodiment of the oven described in WO 01/98092 A1, the main after burner is located within an afterburner chamber integral with the body of the oven and, as the oven is pivoted between the alternative positions, the after burner chamber moves with the oven.

The oven described in WO 01/98092 A1 has been found to work well and thereby providing a commercially and technically acceptable means of thermally de-coating relatively low volumes of materials. However, it has been found that the location of the main afterburner chamber integral with the body of the moving oven is not ideal for certain applications.

It is an object of the present invention to provide an improved oven in which the problems of the known oven are overcome or at least reduced.

Thus, in accordance with a first aspect of the invention there is provided apparatus for thermally de-coating and/or drying coated and/or contaminated materials, the apparatus comprising:

at least one support;

an oven mounted to the or each support and adapted for receiving material to be treated;

each oven being moveable between a first position in which a first portion is generally higher than a second portion and a second position in which the second portion is generally higher than the first portion, such that, in use, the oven can be repeatedly moved between the first and second positions so material within the oven falls from one portion to the other portion;

characterized in that the or each oven does not include an integral afterburner chamber and the apparatus further comprises at least one afterburner for generating a stream of hot gasses and conduit means for directing the stream of hot gasses into a treatment zone of the oven; and exhaust means for returning the gasses to the at least one afterburner.

The treatment zone may be located in the first or second portion of the oven, or partially in each portion, dependent upon the material to be treated and its topology.

The apparatus according to the invention may comprise a single oven and a single afterburner; a single oven and a plurality of afterburners; a plurality of ovens and a single afterburner or a plurality of ovens and a plurality of afterburners.

It is an advantage of the apparatus according to the invention that the provision of an afterburner which is does not pivot with the oven provides a simpler and therefore less expensive solution to the problem of thermally removing coatings and/or impurities from materials.

In accordance with a second aspect of the invention, there is provided a method of thermally de-coating and/or drying coated and/or contaminated materials comprising:

providing an apparatus comprising at least one support and an oven mounted to the or each support and adapted for receiving material to be treated; each oven being moveable between a first position in which a first portion is generally higher than a second portion and a second position in which the second portion is generally higher than the first portion;

placing the material in the or each oven; repeatedly moving the or each oven between said first and second positions so material repeatedly falls from one portion to the other portion;

characterized in that the or each oven does not include an integral afterburner chamber and the apparatus further comprises at least one afterburner for generating a stream of hot gasses and conduit means for directing the stream of hot gasses into a treatment zone of the or each oven and exhaust means for returning the gasses to the at least one afterburner.

BRIEF DESCRIPTION OF THE DRAWINGS

A preferred embodiment of the invention will now be described, by way of example only, with reference to the accompanying drawings in which.

DETAILED DESCRIPTION

Figure 1:
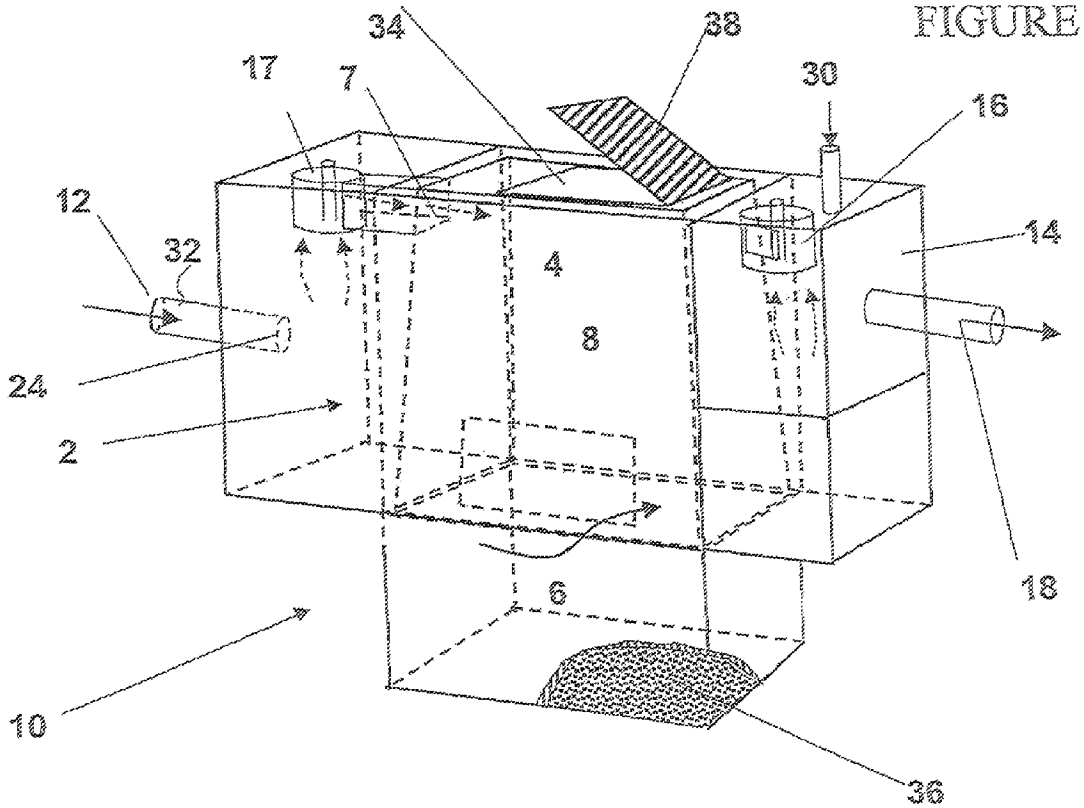
FIG. 1 is a schematic, perspective view of the oven of an apparatus in accordance with the invention.
Figure 2:
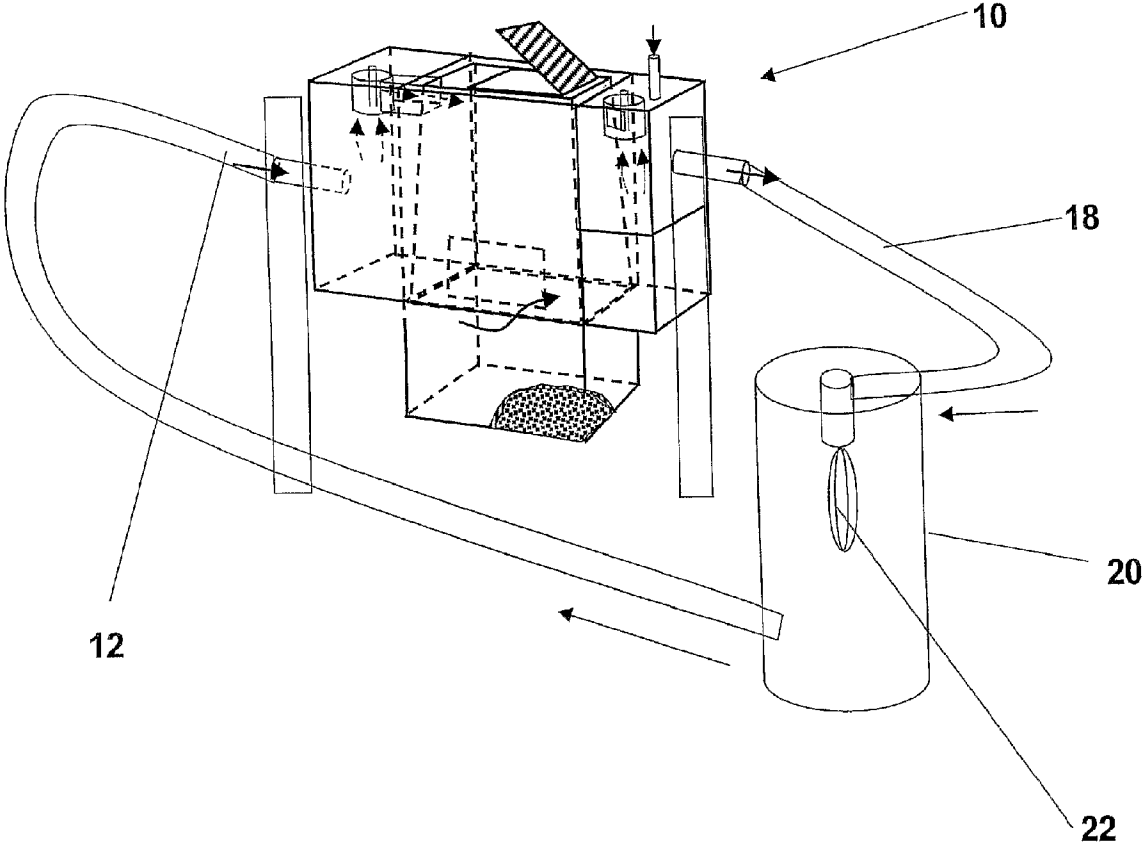
FIG. 2 is a schematic, perspective view of the oven of FIG. 1 in combination with a single afterburner.
Figure 3:
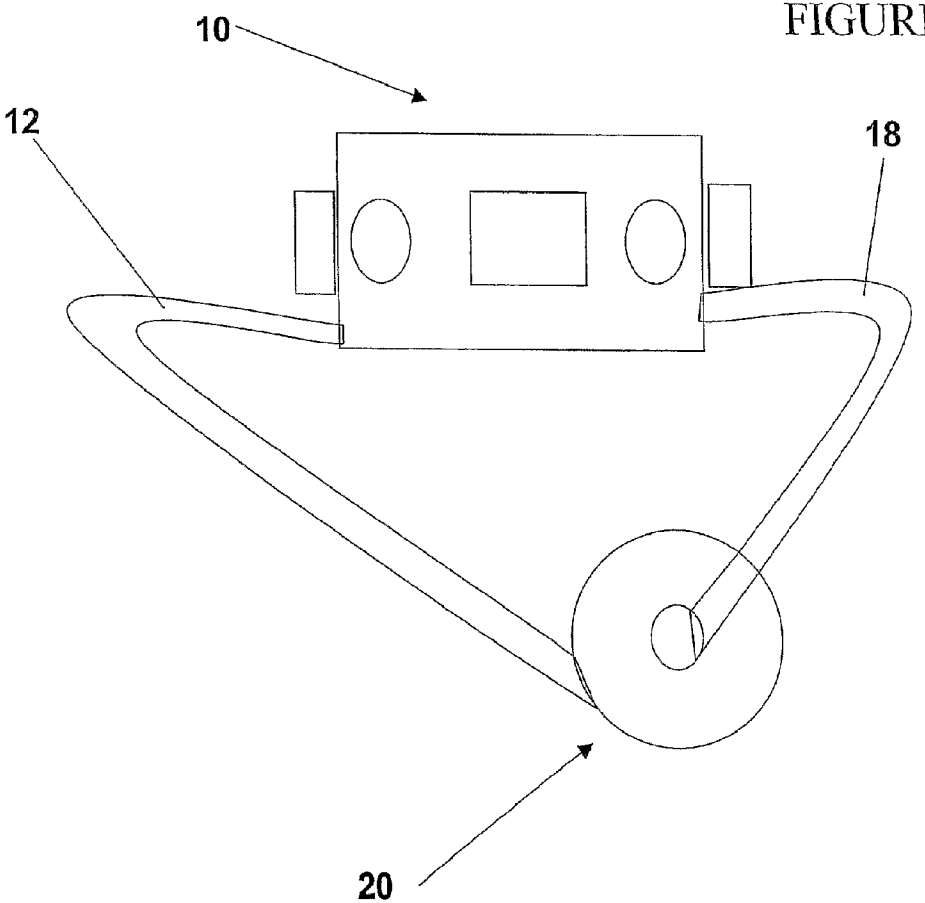
FIG. 3 is a schematic plan view from above of the apparatus of FIG. 2.

Referring to FIGS. 1 to 3, there is shown an oven, indicated generally at 10, which forms part of an apparatus for thermally de-coating and/or drying coated and/or contaminated materials.

The oven 10 comprises a process chamber shown generally at 2 comprising a first portion 4 and a second portion 6, with a central zone 8. The treatment zone comprises the first portion 4 and the central zone 8. A stream of hot gasses 12 can be passed from one side of the oven 10 to the other through the treatment zone.

On one side of the oven is a recirculation chamber 14 into which the gasses are drawn from the central zone 8 through an aperture 7 by a first recirculating fan 16. On the other side of the oven, the hot gases 12 can be drawn by a jet fan 17 into the process chamber 2.

A conduit 18 guides the gases from the recirculation chamber 14 into an afterburner chamber 20 in which the gasses are heated by a burner 22. The walls of the afterburner chamber 20 can be air-cooled stainless steel walls or may be lined with a suitable refractory material.

The burner 22 which heats the gasses may be designed to run on either a gaseous or a liquid fuel or both. In a preferred embodiment the burner is also designed so as to be able to burn the volatile organic compounds (V.O.C.s) which are thermally stripped from the materials in the treatment zone. These V.O.C.s are drawn out of the treatment zone with the gases 12 by the recirculating fan 16 and are mixed with the air 30, if needed, in the recirculation chamber 14.

By burning the V.O.C.s the overall thermal efficiency of the oven is increased since less fuel need be supplied to heat the gases 12 to the required operating temperature. If sufficient V.O.C.s are present, no additional fuel need be added to heat the gases to the required temperature so that the process can operate autothermically.

Burning the V.O.C.s also improves the control of emissions by removing these pollutants from the re-circulating gases and reducing the need for further and expensive treatment of gases which are exhausted from the afterburner chamber as will be described later.

From the afterburner chamber 20, the hot gases enter the treatment zone which extends over the first portion 4 and the central zone 8 of the process chamber 2 through an aperture 24 formed in a side wall of the process chamber 2 on the opposite side of the oven from the recirculation chamber 14. The jet fan 17 directs the hot gases 12 entering the oven through the aperature 24 into the processing chamber 2. The hot gases 12 could also bypass the process chamber 2, drawn by the recirculating fan 16 and proceed to the recirculation chamber 14 without passing through the process chamber 2.

A control system monitors and controls the level of oxygen and the temperature of the gases in the treatment zone to ensure the system operates within safe and effective limits for thermal de-coating of the material being treated. Typically, the oxygen level will be maintained below 16% whilst temperatures in excess of 300° C. are required to remove most organic compounds.

An auxiliary fresh air inlet 30 is also provided in the recirculation chamber 14. The auxiliary inlet 30 allows air to enter the recirculation chamber via an air supply chamber 32 to mix with the hot gases and to cool the fan 16 if needed. The control system monitors the temperature of the fan an operates a valve to control the flow of air through the auxiliary inlet to maintain the temperature of the fan below its maximum permitted operating temperatures. The control system balances the flow of air through the auxiliary inlet 30, if needed, in order to maintain the required oxygen content and temperature of the gases in the conduit 18.

In the embodiment illustrated in the accompanying drawings, an outer wall of the firs portion 4 of the process chamber 2 includes an aperture 34 for receiving scrap material 36 to be treated. The aperture 34 is closed by a door 38.

In an alternative embodiment (not illustrated), the second portion 6 may be in the form of a charging box that could be detached from the oven 10 and used to load the scrap material 36 to be treated. In this embodiment, during the oven treatment cycle, the charging box forms an integral part of the oven and rotates with the oven. After the treatment cycle is completed, the scrap material 36 can be unloaded by removing the charging box 6 via other means such as a fork-lift.

Figure 6:
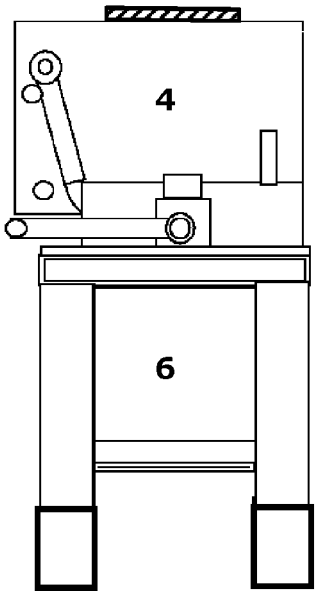
FIG. 6 is a schematic side view of an embodiment of a support structure suitable for use with the oven of FIG. 1.
Figure 7:
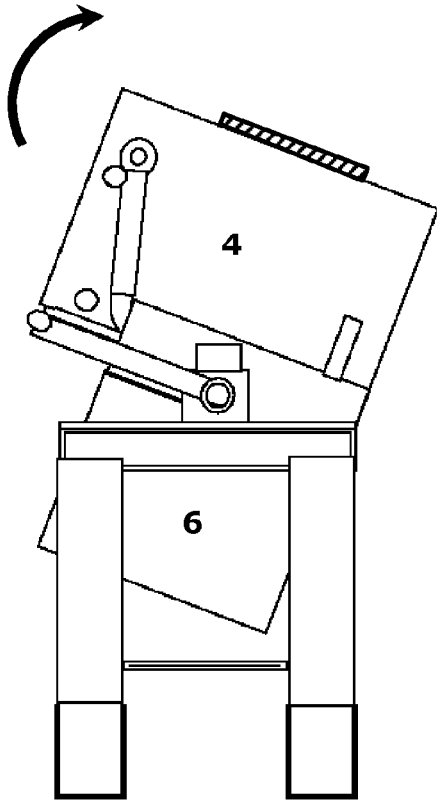
FIG. 7 is a schematic side view of the oven of FIG. 1 with the oven in a first position.
Figure 8:
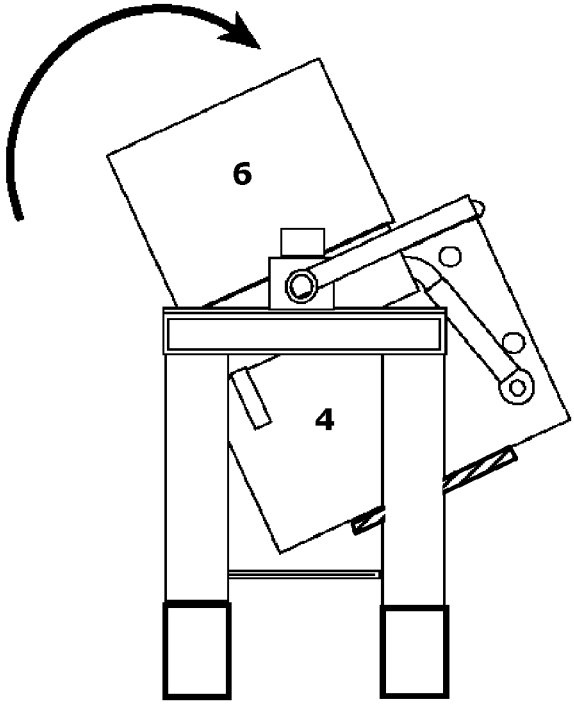
FIG. 8 is a schematic side view of the oven of FIG. 1 with the oven in a second position.

The oven 10 is pivotably mounted to a support structure and can be moved (FIG. 7) between a first position (FIG. 6) in which the first portion 4 is higher than the second portion 6 and a second position (FIG. 8) in which the second portion 6 is higher than the first portion 4. In an alternative mode of operation, the movement could be in a continuous rotational movement, completing 360-degree motion.

Means (not shown) are provided for automatically moving the oven between the first and second positions under the control of the control system for the apparatus. This means can be of any suitable form and may for example comprise one or more electric or hydraulic motors. The motors may act through a gearbox if required. Alternatively the means may comprise one or more hydraulic or pneumatic rams. The means could also comprise a combination of motors and rams.

Figure 4:
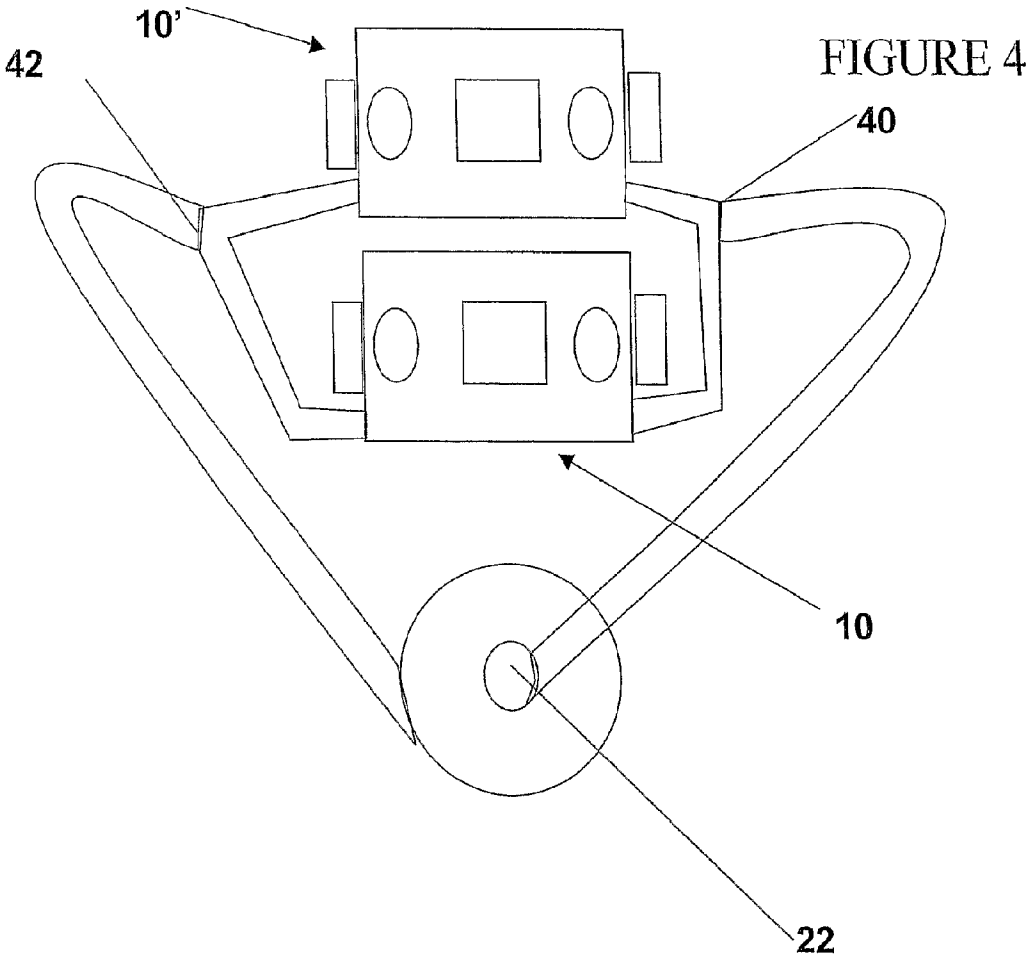
FIG. 4 is a schematic plan view from above of a second embodiment of an apparatus according to the invention comprising two ovens and a single afterburner.

In the alternative arrangement shown in FIG. 4, a single after burner 22 is connected to two ovens 10, 10' by means of manifolds 40, 42.

Figure 5:
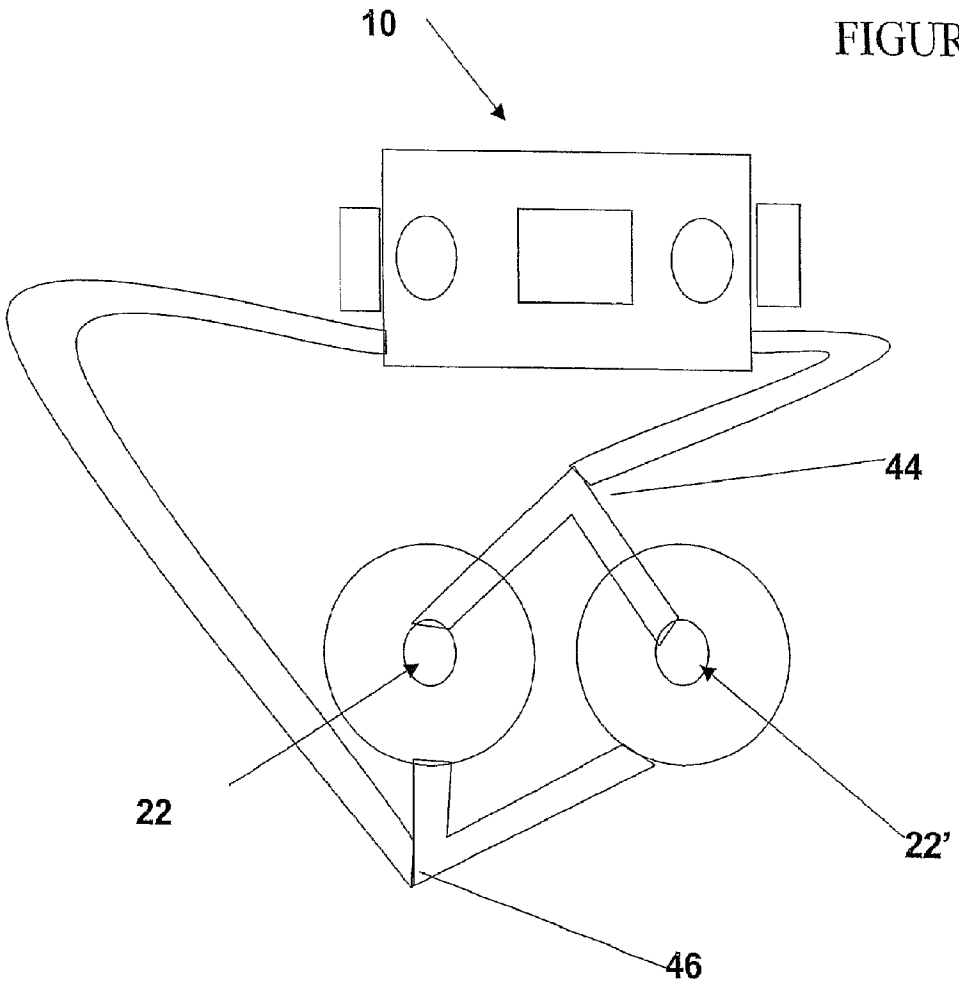
FIG. 5 is a schematic plan view from above of a third embodiment of an apparatus according to the invention comprising a single oven and two afterburners.

In the second alternative arrangement shown in FIG. 5, two after burners 22, 22' are connected by means of manifolds 44, 46 to a single oven 10.

Operation of the apparatus will now be described.

The material 36 to be processed is loaded via the aperture 34 into the process chamber 2 and falls under gravity to the second portion 6. The treatment process can then be initiated under the control of the control system.

The gases passing through the treatment zone are heated and the oven rotated from the first position it reaches the second position in which the oven is nearly inverted.

As the oven is rotated, the materials in the process chamber 2 will fall under the influence of gravity into the first portion 4 passing through the stream of hot gases in the treatment zone. It should be noted that the material passes through the stream of hot gases 12 tranversely to the direction of flow of the hot gases through the treatment zone.

The rotary movement of the oven can continue to complete 360 degrees or be reversed until the oven reaches the first position. During this rotary movement, the materials will fall from the first portion 4 into the second portion 6, again passing through the stream of hot gases 12. The rotational movement of the oven between the first and second positions is repeated a number of times as required by the process control until the material 36 is fully treated.

The treatment process goes through a number of phases or cycles: a heating cycle during which the hot gases and the materials are brought up to the required treatment temperature, a treatment cycle in which the temperature of the gasses and materials is maintained at the treatment temperature, and finally a cooling cycle during which the temperature of the gases and the treated material is brought down to a level at which the material can be safely removed.

Once the treatment process is completed, the oven is returned to the starting position and the door 38 is opened, so that the treated material can be transported for cooling, storage or further processing as required.

The rotary motion of the oven ensures that the material to be treated passes through the stream of gases in the treatment chamber in a controlled manner. The falling action of the material also ensures that all the surfaces of the material become fully exposed to the gases promoting an efficient and effective de-coating and/or decontamination.

The control system controls the speed and frequency of the rotary movement of the oven along with the temperature and oxygen level of the gases in order to oxidize coatings or impurities on the material 36 whilst ensuring the process is carried out safely and efficiently with minimum loss of the material being treated.

A particular feature of the apparatus is the ability for the system to stop the rotary motion of the oven at any time. This can be particularly useful when treating heavily coated materials to ensure that the temperature in the afterburner does not increase in an uncontrolled manner due to the high level of V.O.C.s present in the gases. When the apparatus stops rotating, the amount of combustible material in the gases is reduced and the combustion process slows down and hence the temperature drops back to the controlled level. As the temperature returns to acceptable levels, the apparatus resumes rotation and the treatment process continues. This ability to stop the rotation of the oven ensures a controlled volatile release throughout the treatment process. The combustion process can be further slowed down by stopping the oven in a position in which the material drops into the second portion 6. This ensures the material is out of the gas flow and away from the hot surfaces of the treatment zone.

In addition to the rotary movement of the oven, the apparatus may be provided with means, such as an electro/mechanical vibrator (not shown), for vibrating the oven or at least a part of the oven. The vibration means can also be controlled by the control system. This additional vibrating action allows the apparatus to transfer the materials between the first portion 4 and the second portion 6 in a finer and more controlled quantity to promote a better exchange between the hot gases and the material.

The vibration motion can also be used to facilitate mechanical stripping of the coating and contaminates from the material 36. For example, the arrangement can be such that the material is vibrated at a frequency which is equal or close to its natural or resonance frequency. Alternatively, the oven (or at least parts of the oven such as the first portion 4 and/or the second portion 6) can be vibrated at its natural or resonance frequency. Hence allowing the material to vibrate efficiently which increases the abrasion forces and allows the gases to penetrate and treat the material 36.

The apparatus in accordance with the invention is particularly suited for treatment of relatively small quantities of material. This enables a cost effective treatment of materials on much smaller scales than the known rotary kiln or conveying oven apparatus but without the drawbacks of the static oven. Because the materials are processed in batches, the apparatus can be adapted to treat a variety of materials by resetting of the control system between batches.

The apparatus according to the invention can be made relatively small compared with the known rotary kilns or conveying ovens and so takes up much less floor space. The apparatus in accordance with the invention is also relatively simple and requires less maintenance than the known apparatus.

A further advantage of the apparatus in accordance with the invention is that it requires less supporting equipment than the known rotary kiln and conveying oven apparatus which typically require in feed conveyor belts, discharging conveyor belts, and storage hoppers to maintain a continuous operation.

The apparatus described above can be modified in a number of ways. For example, a jet stirring system (not shown) can be provided to agitate and stir the material in the heat treatment chamber. This allows the hot gases in the heat treatment chamber to reach more of the material being treated and so improves the efficiency of the process. Such a system may comprise one or more jets which can emit a constant stream or blasts of a gaseous material to stir the material in that heat treatment chamber. The gaseous material may be fresh air and may form part of the control system for controlling the oxygen and temperature levels in the oven. Alternatively, the gaseous material can be part of the gases 12 recirculating about the oven.

It is also possible to incorporate one or more tools (not shown) into the apparatus in order to carry out further treatment or control of the material in the oven. Examples of the type of tools (not shown) which may be incorporated into the apparatus include:

a shredding means for shredding the material as it drops from the first portion 4 into the second portion 6. Such a shredding means may be a rotary shear shredder or any other suitable form of shredder known in the art.

Alternatively or in addition, the apparatus may hold an electromagnetic non-ferrous metal separator for separating non-ferrous metals from the rest of the material being treated. The separator acts on the material passing between the first portion 4 and the second portion 6. Typically such a separation will be carried out towards the end of the cooling cycle of the process and the non-ferrous metal will be collected in a separate bin from the rest of the material. The separator may be of any suitable type such as those which are know in the art.

A feeding means may also be provided in the apparatus to control the movement of the material between the first portion 4 and the second portion 6. The feeding means may comprise a damper system or any other suitable system for controlling the release of material from the second portion 6. The use of such a feeding means allows material to be slowly released from the second portion 6 into the first portion 4 for treatment in a substantially continuous manner. This can be useful in controlling the release of V.O.C.s.

The invention claimed is:

1. Apparatus for thermally treating contaminated materials in batch processing manner, the apparatus comprising:

at least one oven adapted for receiving a batch of material to be treated;

said oven being moveable between a first position in which a first portion is generally higher than a second portion and a second position in which the second portion is generally higher than the first portion; and control means to control the speed and frequency of the movement of the oven between first and second positions;

wherein the oven does not include an integral afterburner chamber and wherein in that the apparatus further comprises at least one afterburner for generating a stream of hot gasses and conduit means for directing the stream of hot gasses into a treatment zone of the oven and exhaust means for returning the gasses to the at least one afterburner; and wherein movement of the oven from the first position to the second position causes the contaminated material being treated to fall into the first position, and subsequent movement to the second position causes the contaminated material to fall into the second portion in each case with the material passing through the stream of hot gasses.

2. Apparatus according to claim 1 characterised in that the first portion includes a selectively closable aperture formed in one wall thereof, configured to receive material to be treated.

3. Apparatus according to claim 1 characterised in that the second portion of the oven is detachable from the first portion and is adapted to receive material to be treated as a charging box.

4. Apparatus according to claim 3, wherein the apparatus comprises a plurality of ovens and at least one afterburner.

5. Apparatus according claim 3 wherein the apparatus comprises a single oven and a plurality of afterburners.

6. Apparatus according to claim 1 wherein the apparatus includes a plurality of ovens and at least one afterburner.

7. Apparatus according to claim 1 wherein the apparatus comprises a single oven and a plurality of afterburners.

8. Apparatus according to claim 1 further comprising means for vibrating at least a part of the oven.

9. Apparatus according to claim 8 wherein the vibration means activates natural resonance frequency.

10. Apparatus according to claim 1 wherein the oven further comprises a heat transfer chamber and wherein the apparatus further comprises a jet stirring system configured to agitate and stir the heat transfer chamber of the oven.

11. Apparatus according to claim 1 wherein the control means are configured to monitor and control oxygen levels in the oven.

12. Apparatus according to claim 11 wherein the control means are configured to control the movement of the oven between first and second positions in response to conditions in the oven.

13. The apparatus according to claim 1 wherein the first portion of the oven includes a selectively closeable aperture formed in one wall thereof configured to receive material to be treated and wherein the second portion of the oven is detachable from the first portion and is adapted to receive material to be treated as a charging box.

14. The apparatus according to claim 13 further comprising means for vibrating at least a portion of the oven.

15. The apparatus of claim 13 further comprising a jet stifling system configured to agitate and stir the heat transfer chamber of the oven.

16. A method of thermally de-coating and/or contaminated materials comprising:

providing an apparatus comprising an oven adapted for receiving material to be treated; the or each oven being moveable between a first position in which a first portion of the or each oven is generally higher than a second portion and a second position in which the second portion is generally higher than the first portion; and which apparatus includes control means to control the speed and frequency of said movement of the oven between first and second positions, placing the material in the or each oven;

moving the or each oven from the first position to the second positions, so that the material in the or each oven falls from the second portion to the first portion;

subsequently, moving the or each oven from the second position so that the material in the or each oven falls from the first portions returning to the second position;

characterised in that the or each oven does not include an integral afterburner chamber and in that the apparatus further comprises at least one afterburner for generating a stream of hot gasses and conduit means for directing the stream of hot gasses generated by the at least one afterburner into a treatment zone of the or each oven and exhaust means for returning the gasses to the at least one afterburner.

* * * * *